United States Patent [19]

Detter et al.

[11] Patent Number: 4,781,628

[45] Date of Patent: Nov. 1, 1988

[54] FEMALE ELECTRICAL TERMINAL

[75] Inventors: Gary C. Detter, Berlin Center; Duane L. Brantingham, Cortland; Richard A. Petrosky, Warren, all of Ohio

[73] Assignee: General Motors Corporation, Detroit, Mich.

[21] Appl. No.: 111,353

[22] Filed: Oct. 22, 1987

[51] Int. Cl.[4] ..... H01R 13/432

[52] U.S. Cl. ..... 439/748; 439/850

[58] Field of Search ..... 439/266, 268–270, 439/744–749, 845, 846, 849, 850, 867, 871, 872

[56] References Cited

U.S. PATENT DOCUMENTS

| | | | |
|---|---|---|---|
| 3,058,091 | 10/1962 | Henschen | 439/872 |
| 3,188,606 | 6/1965 | De Lyon et al. | 339/256 |
| 3,215,975 | 11/1965 | Kinkaid | 339/256 |
| 3,425,030 | 1/1969 | Hadden | 339/256 |
| 3,550,067 | 12/1970 | Hansen | 339/217 |
| 3,842,391 | 10/1974 | Dechelette | 339/32 |
| 3,976,348 | 8/1976 | Simmons | 339/74 |
| 4,159,160 | 6/1979 | Plyler et al. | 339/217 |
| 4,319,797 | 3/1982 | Otani et al. | 339/75 |
| 4,346,959 | 8/1982 | Daugherty et al. | 339/217 |
| 4,390,231 | 6/1983 | Plyler et al. | 339/217 |
| 4,472,017 | 9/1984 | Sian | 339/217 |
| 4,550,963 | 11/1985 | Moors | 339/31 |
| 4,558,913 | 12/1985 | Goto et al. | 439/268 |
| 4,579,409 | 4/1986 | Enneper et al. | 339/74 |
| 4,632,483 | 12/1986 | Verin | 339/74 |
| 4,713,026 | 12/1987 | Mobley et al. | 439/845 |

FOREIGN PATENT DOCUMENTS

| | | | |
|---|---|---|---|
| 1251648 | 12/1960 | France | 439/849 |

OTHER PUBLICATIONS

Interlock Corporation Drawing Entitled 0.125" Spring On, 10/86.

*Primary Examiner*—Gil Weidenfeld
*Assistant Examiner*—Gary F. Paumen
*Attorney, Agent, or Firm*—F. J. Fodale

[57] ABSTRACT

A miniature female electrical terminal of unitary sheet metal construction comprises a receptacle, a forward appendage which is juxtaposed the receptacle and which has a tang and spaced side rails which protect the latch tang, and a rearward appendage for assistance in inserting the terminal into a terminal cavity of a connector body.

4 Claims, 1 Drawing Sheet

FEMALE ELECTRICAL TERMINAL

BACKGROUND OF THE INVENTION

This invention relates generally to electrical terminals and more specifically to female electrical terminals having resilient latch tangs for retaining the terminals in terminal cavities of a connector body.

It is conventional practice to provide electrical terminals with a resilient latch tang or tangs, which upon terminal insertion, deflect and snap over rigid shoulders in terminal cavities to retain the terminals in the terminal cavities of the connector body.

Electrical terminals which are structured to provide protection for their resilient latch tangs are also known. See for instance, U.S. Pat. No. 3,215,975 (Kinkaid) issued Nov. 2, 1965; U.S. Pat. No. 4,159,160 (Plyler et al) issued June 26, 1979 and U.S. Pat. No. 4,390,231 (Plyler et al) issued June 28, 1983.

SUMMARY OF THE INVENTION

The object of this invention is to provide a female electrical terminal having a resilient latch tang, particularly, a miniature female electrical terminal, which is structured to protect the resilient latch tang.

A feature of the invention is that the structure which protects the resilient latch tang is part of an appendage which is juxtaposed the receptacle of the female terminal thereby providing versatility in configuring and sizing the receptacle itself.

Another feature of the invention is that the resilient latch tang may also be a part of the appendage thereby improving protection of the resilient latch tang and providing even greater versatility in configuring and sizing the receptacle of the female electrical terminal.

Still other features of the invention are that the protective structure of the appendage may take the form of side rails and may be used to insure that the female electrical terminal is oriented correctly for insertion into the terminal cavity of the connector body.

In another aspect the object of this invention is to provide a female electrical terminal, particularly a miniature female electrical terminal, which includes structure which may be used to assist in the insertion of the female electrical terminal into a terminal cavity of a connector body.

In this regard a feature of the invention is that the miniature female electrical terminal has a rearward appendage which is offset from its crimp barrels to provide structure for assisting in the insertion of the miniature terminal into the terminal cavity.

Other objects and features of the invention will become apparent to those skilled in the art as disclosure is made in the following detailed description of a preferred embodiment of the invention which sets forth the best mode of the invention contemplated by the inventors and which is illustrated in the accompanying sheet(s) of drawing.

DETAILED DESCRIPTION OF THE PREFERRED EMBODIMENT

Figure 1:
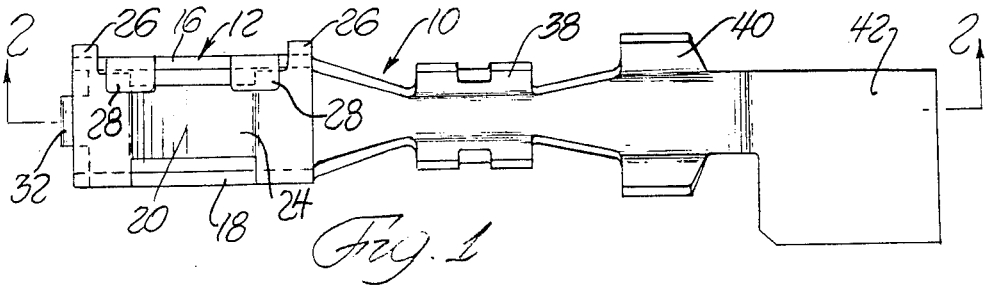
FIG. 1 is a top view of a miniature female electrical terminal in accordance with the invention.

Referring now to the drawing a miniature female electrical terminal of unitary sheet metal construction is indicated generally at 10. The terminal 10 is elongated and has a rectangularly shaped receptacle 12 at one longitudinal end which, for example, may be about ¼" long, about ⅛" wide and about 1/16" high.

Figure 5:
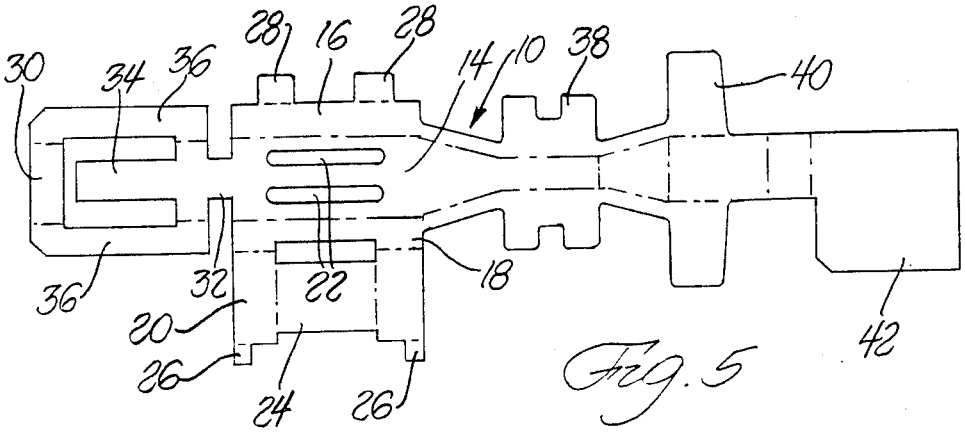
FIG. 5 is a plan view of the stamped sheet metal blank for making the terminal which is shown in FIGS. 1, 2, 3 and 4.

The rectangularly shaped receptacle 12 has a floor 14, side walls 16 and 18 which are integrally attached to the longitudinal sides of the floor 14 and a top wall 20 which is integrally attached to the side wall 18 as shown in FIG. 5. The floor 14 has two longitudinal raised ridges 22 which increase the stiffness of floor 14 and provide support for a male electrical terminal or tab (not shown) which is inserted into the receptacle 12. The top wall 20 has a resilient contact bow 24 which extends into the receptacle to engage the inserted tab (not shown) which is supported on the raised ridges 22.

The top wall 20 has longitudinally spaced tabs 26 at its free longitudinal side which cooperate with spaced tabs 28 at the free longitudinal side of the side wall 16. The tabs 26 and 28 are bent over the respective side wall and top walls 16 and 20 to maintain the rectangular shape of the receptacle 12 which is folded from a flat blank shown in FIG. 5 into the rectangular shape which is shown in FIGS. 1, 2, 3 and 4.

Figure 2:
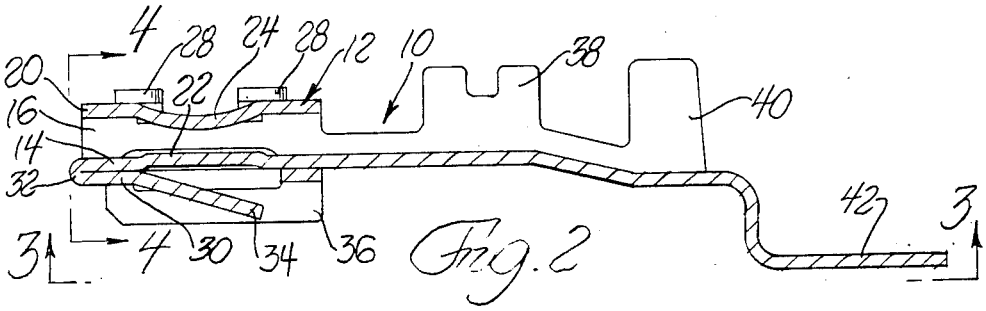
FIG. 2 is a longitudinal section of the terminal taken substantially along the line 2—2 of FIG. 1 looking in the direction of the arrows.
Figure 3:
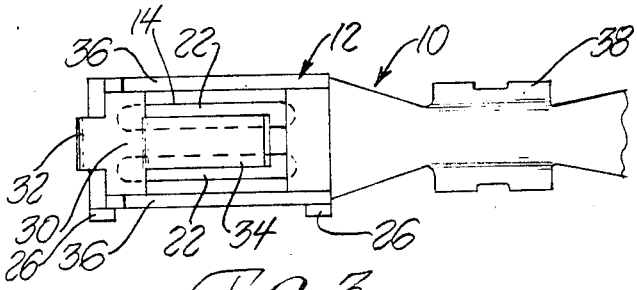
FIG. 3 is a fragmentary bottom view of the terminal which is shown in FIGS. 1 and 2.
Figure 4:
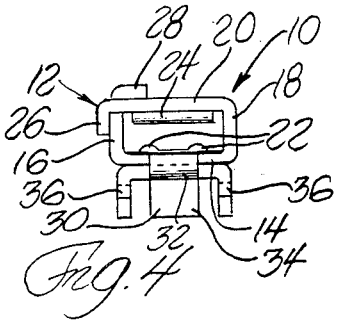
FIG. 4 is a front view of the terminal taken substantially along the line 4—4 of FIG. 1 looking in the direction of the arrows.

The terminal 10 further includes a forward appendage 30 which is attached to the end of the floor 14 by a short tab which is reversely bent to form a bight 32 which attaches the forward appendage 30 to the floor 14 at the forward end of the terminal 10 so that the forward appendage 30 is juxtaposed the exterior side of the floor 14 as best shown in FIGS. 2 and 4.

The forward appendage 30 has a resilient latch tang 34 which stamped out of the forward appendage 30 and bent so that the latch tang 34 slants away from the floor 14 of the receptacle 12 in the rearward direction when the forward appendage 14 is juxtaposed the exterior wall of the floor 14. The forward appendage 30 also has spaced side rails 36 which are bent upright from the longitudinal side portions of the forward appendage 30 to protect the latch tang 34. The side rails 36 which are located on either side of the resilient latch tang 34 and extend away from the floor 14 by a distance which is substantially at least as great, as and preferably a little greater than the maximum distance which the latch tang 34 extends away from the floor 14 as best shown in FIGS. 2 and 4.

The side rails 36 may also be used advantageously as a means to insure proper orientation of the terminal 10 when it is inserted into a terminal cavity of a connector body (not shown) by providing unique cooperating slots in the terminal cavity which receive the side rails 36 when the terminal 10 is inserted correctly.

The terminal 10 further includes conductor core and insulation crimp barrels 38 and 40 respectively for attaching the terminal to the conductor core and insulation jacket of an insulated conductor (not shown) in a conventional manner.

The terminal 10 further includes a rearward appendage 42 at the rearward end of the terminal 10 behind the crimp barrels 38 and 40. This rearward appendage 42 is L-shaped and offset from the crimp barrels 38 and 40 in the vertical direction as shown in FIG. 2 so that the vertical leg is exposed and the longitudinal leg of rearward L-shaped appendage is spaced from the insulated conductor (not shown) after the terminal 10 is attached to such a conductor. Thus the L-shaped rearward appendage 42 may be used to assist in the insertion of the terminal 10 into a terminal cavity of a connector body (not shown) or to insure the full insertion of the terminal into its proper position in the terminal cavity.

We wish it to be understood that we do not desire to be limited to the exact details of construction shown and described, for obvious modifications will occur to a person skilled in the art.

The embodiments of the invention in which an exclusive property or privilege is claimed are defined as follows:

1. In an electrical terminal of unitary sheet metal construction having a floor and a resilient latch tang which slants away from a side of the floor in an outward direction, the improvement comprising;

an appendage which is attached to the floor at an end of the terminal by a bight so that the appendage is juxtaposed to the said side of the floor, said appendage having spaced side walls which project away from the said side of the floor for protecting the resilient latch tang, said side rails extending away from the said side of the floor by a distance which is substantially at least as great as the distance which the latch tang extends away from the same side of the floor.

2. A female electrical terminal of unitary sheet metal construction comprising:

a receptacle at one end of the terminal which has a floor, side walls, and a top wall, and an appendage which is attached to the floor at an end of the terminal by a bight so the appendage is juxtaposed to an exterior side of the floor, and said floor having a pair of raised ridges projecting into the receptacle for supporting a tab or the like inserted into the receptacle, and said appendage having a resilient latch tang which slants away from the floor in an outward direction whereby the width of the resilient latch tang is independent of the spacing between the pair of raised ridges, and said appendage having spaced side walls on either side of the latch tang which project away from the floor of the receptacle by a distance which is substantially at least as great as the distance which the latch tang extends away from the floor for protecting the latch tang.

3. A miniature female electrical terminal of unitary sheet metal construction comprising:

a receptacle at a forward end of the terminal which has a floor, side walls and a top wall, a crimp barrel rearwardly of the receptacle for attaching the terminal to a conductor, a forward appendage which is attached to the floor at the forward end of the terminal by a bight so that the forward appendage is juxtaposed to an exterior side of the floor, and a rearward appendage behind the crimp barrel which is offset from the crimp barrel for assisting in the insertion of the terminal into a terminal cavity of a connector body, said floor of the receptacle having a pair of raised ridges projecting into the receptacle for supporting a tab or the like inserted into the receptacle, and said forward appendage having a latch tang which slants away from the floor of the receptacle in the rearward direction and spaced side rails on either side of the latch tang for protecting the latch tang, said side rails extending away from the floor by a distance which is substantially at least as great as the distance which the latch tang extends away from the floor.

4. The miniature female electrical terminal as defined in claim 3 wherein the rearward appendage is L-shaped so that it has a vertical leg which is exposed and a longitudinal leg which is spaced vertically from a conductor when attached to the terminal by the crimp barrel.

* * * * *